US008006687B2

(12) United States Patent
Watkins et al.

(10) Patent No.: US 8,006,687 B2
(45) Date of Patent: Aug. 30, 2011

(54) APPLIANCE WITH A VACUUM-BASED REVERSE AIRFLOW COOLING SYSTEM

(75) Inventors: Derek Lee Watkins, Elizabethtown, KY (US); James Armstrong, Louisville, KY (US); Philip Ames Barber, Louisville, KY (US); Jay Andrew Broniak, Louisville, KY (US); Steve B. Froelicher, Shepherdsville, KY (US); Kevin Scott Laundroche, Anchorage, KY (US); Michael Paul McGonagle, Louisville, KY (US)

(73) Assignee: General Electric Company, Schenectady, NY (US)

( * ) Notice: Subject to any disclaimer, the term of this patent is extended or adjusted under 35 U.S.C. 154(b) by 477 days.

(21) Appl. No.: 12/209,280

(22) Filed: Sep. 12, 2008

(65) Prior Publication Data

US 2010/0065036 A1 Mar. 18, 2010

(51) Int. Cl.
*F24C 15/32* (2006.01)

(52) U.S. Cl. ..... 126/198; 126/193; 126/287; 312/296

(58) Field of Classification Search ..... 126/193, 126/198, 287
See application file for complete search history.

(56) References Cited

U.S. PATENT DOCUMENTS

| | | | | | |
|---|---|---|---|---|---|
| 3,142,748 | A | * | 7/1964 | Warren | 219/392 |
| 3,409,003 | A | * | 11/1968 | Rehberg et al. | 126/190 |
| 3,509,868 | A | * | 5/1970 | Mono | 126/198 |
| 3,889,100 | A | * | 6/1975 | Dills | 219/393 |
| 4,180,049 | A | * | 12/1979 | Carr et al. | 126/21 A |
| 4,354,084 | A | * | 10/1982 | Husslein et al. | 219/757 |
| 4,592,333 | A | * | 6/1986 | Dustin | 126/21 R |
| 4,763,638 | A | * | 8/1988 | Hurley et al. | 126/21 A |
| 4,796,600 | A | * | 1/1989 | Hurley et al. | 126/273 A |
| 5,193,520 | A | | 3/1993 | Gostelow et al. | |
| 5,215,073 | A | * | 6/1993 | Wilson | 126/19 R |
| 5,738,081 | A | * | 4/1998 | Puricelli | 126/21 A |
| 5,918,589 | A | * | 7/1999 | Valle et al. | 126/193 |
| 6,300,609 | B1 | | 10/2001 | Kim | |
| 6,344,637 | B2 | * | 2/2002 | Lee et al. | 219/757 |
| 6,515,266 | B2 | | 2/2003 | Nasu et al. | |
| 6,786,058 | B2 | * | 9/2004 | Sanna | 62/229 |
| 6,913,012 | B2 | * | 7/2005 | Divett et al. | 126/21 A |
| 6,967,310 | B2 | * | 11/2005 | Austin et al. | 219/408 |
| 6,984,811 | B2 | | 1/2006 | Lee | |
| 7,030,773 | B2 | | 4/2006 | Peterson et al. | |
| 7,211,775 | B2 | | 5/2007 | Lee | |
| 7,348,527 | B2 | | 3/2008 | Braunisch et al. | |

(Continued)

FOREIGN PATENT DOCUMENTS

JP 01139920 A 6/1989

(Continued)

*Primary Examiner* — Kenneth B Rinehart
*Assistant Examiner* — Jorge Pereiro
(74) *Attorney, Agent, or Firm* — Global Patent Operation; Douglas D. Zhang

(57) ABSTRACT

An appliance is disclosed. The appliance includes a main body defining a cavity and an air channel which is in flow communication with an outside of the appliance; an access door supported by the main body for selectively closing the cavity, the access door having an airway in flow communication with the outside of the appliance and the air channel; a fan disposed in the air channel; and an Human Machine Interface disposed on or in the access door. When activated, the fan causes ambient air from the outside of the appliance to pass through the airway before entering the air channel so that the access door is cooled off by the ambient air.

20 Claims, 5 Drawing Sheets

U.S. PATENT DOCUMENTS

| | | | | |
|---|---|---|---|---|
| 7,650,881 | B2 | 1/2010 | Brown et al. | |
| 7,708,008 | B2 * | 5/2010 | Elkasevic et al. | 126/198 |
| 7,726,295 | B2 * | 6/2010 | Elkasevic | 126/198 |
| 7,762,250 | B2 * | 7/2010 | Elkasevic et al. | 126/198 |
| 2003/0131620 | A1 * | 7/2003 | Sanna | 62/229 |
| 2003/0168447 | A1 | 9/2003 | Lee | |
| 2004/0079355 | A1 * | 4/2004 | Divett et al. | 126/21 R |
| 2005/0133019 | A1 * | 6/2005 | Kim et al. | 126/198 |
| 2005/0224490 | A1 * | 10/2005 | Austin et al. | 219/408 |
| 2006/0049191 | A1 | 3/2006 | Lee | |
| 2006/0137543 | A1 | 6/2006 | McLemore et al. | |
| 2006/0219234 | A1 | 10/2006 | Larsen et al. | |
| 2006/0272632 | A1 | 12/2006 | Duncan et al. | |
| 2007/0102426 | A1 | 5/2007 | Braunisch et al. | |
| 2007/0210057 | A1 | 9/2007 | Stahl et al. | |
| 2008/0105140 | A1 | 5/2008 | Lee et al. | |
| 2008/0184985 | A1 * | 8/2008 | Hasslberger et al. | 126/21 R |
| 2008/0185372 | A1 * | 8/2008 | Elkasevic | 219/391 |
| 2008/0185373 | A1 * | 8/2008 | Elkasevic et al. | 219/394 |
| 2008/0185941 | A1 * | 8/2008 | Geiger et al. | 312/223.1 |
| 2008/0185942 | A1 * | 8/2008 | Elkasevic et al. | 312/236 |
| 2009/0032010 | A1 * | 2/2009 | Hoffmeier | 126/198 |
| 2009/0145031 | A1 * | 6/2009 | Collene | 49/113 |
| 2009/0183723 | A1 * | 7/2009 | Hasslberger et al. | 126/21 A |
| 2010/0051244 | A1 | 3/2010 | Armstrong et al. | |
| 2010/0101556 | A1 * | 4/2010 | Dell'Oglio et al. | 126/21 A |

FOREIGN PATENT DOCUMENTS

| | | | |
|---|---|---|---|
| WO | 2003077601 | A1 | 9/2003 |
| WO | 2006021936 | A1 | 2/2006 |
| WO | 2007080037 | A1 | 7/2007 |
| WO | 2008032903 | A1 | 3/2008 |

* cited by examiner

APPLIANCE WITH A VACUUM-BASED REVERSE AIRFLOW COOLING SYSTEM

CROSS-REFERENCE TO RELATED APPLICATIONS

This application relates to the commonly owned application entitled "Appliance with a Vacuum-Based Reverse Airflow Cooling System Using One Fan", Ser. No. 12/209,545, filed concurrently.

BACKGROUND OF THE INVENTION

The present invention relates generally to an appliance. More particularly, the present invention relates to an appliance with a vacuum-based reverse airflow cooling system.

Dual-cavity ovens typically draw in ambient or cooling air via intakes located above the upper oven cavity and at the top of the oven where the controls are situated. The air then encounters a fan, which in turn blows the air down the back of the upper and lower oven units. The exhaust for this type of system is usually evacuated at locations between the upper and lower oven units and also below the lower oven unit on the front side of the oven.

This design, however, limits where the oven control panel can be located, constraining it usually to a dedicated, separate area over the oven door where an air intake is sometimes located. Desirably, the control panel would be mounted in the door itself, for convenience, and to increase the effective heating/cooking space and volume that could be used for purposes other than housing the control panel, such as increasing the size of the oven cavity. But oven doors in dual-cavity ovens employing these typical cooling configurations prove to be too hot to serve as a suitable site for the control panel, which can be damaged and malfunction because of the excessive heat.

BRIEF DESCRIPTION OF THE INVENTION

As described herein, the embodiments of the present invention overcome one or more of the above or other disadvantages known in the art.

One aspect of the present invention relates to an appliance. The appliance includes a main body defining a cavity and an air channel which is in flow communication with an outside of the appliance; an access door supported by the main body for selectively closing the cavity, the access door having an airway in flow communication with the outside of the appliance and the air channel; a fan disposed in the air channel; and a Human Machine Interface disposed on or in the access door. When activated, the fan causes ambient air from the outside of the appliance to pass through the airway before entering the air channel so that the access door is cooled by the ambient air.

Another aspect of the present invention relates to an appliance. The appliance includes a main body defining a first cavity, a second cavity adjacent to the first cavity, and an air channel which is in flow communication with an outside of the appliance; a first access door attached to the main body for selectively closing the first cavity, the first access door having a first airway in flow communication with the outside of the appliance and the air channel; a second access door attached to the main body for selectively closing the second cavity, the second access door having a second airway in flow communication with the outside of the appliance and the air channel; and a fan disposed in the air channel. When activated, the fan causes ambient air from outside of the appliance to pass through the first airway and the second airway before entering the air channel so that the first and second access doors are cooled by the ambient air.

Yet another aspect of the invention relates to an appliance. The appliance includes a cabinet having a top, a bottom, opposing sides, a back, an open front, upper and lower oven cavities, and upper and lower access doors for selectively closing the respective upper and lower oven cavities, the upper access door having a lower edge and the lower access door having an upper edge, the lower and upper edges defining a space therebetween. The cabinet defines a first air flow channel disposed between the top and back and the upper and lower oven cavities, the first air flow channel having a first air inlet; a center air channel between the upper and lower oven cavities and in flow communication with the air chamber; an internal airway in each of the upper and lower access doors, each internal airway having a second air inlet and an air outlet which is in flow communication with the center air channel; and a lower air channel extending back to front beneath the lower oven cavity and in flow communication with the first air flow channel. The oven further includes a fan disposed proximate the back portion of the appliance, the fan being configured to create negative pressure to pull ambient air through the first and second air inlets and the internal airways of the upper and lower access doors and force air through the lower air channel to the exterior of the appliance so that the upper and lower access doors are cooled by the ambient air.

Yet another aspect of the invention is the integration of a Human Machine Interface (HMI) consisting e.g. of an arrangement of keys and knobs to control the oven, into the door of an oven employing the reverse airflow system of the present invention. The term "HMI" as used herein can include or be separate from a conventional a control panel.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE PREFERRED EMBODIMENTS OF THE INVENTION

Figure 1:
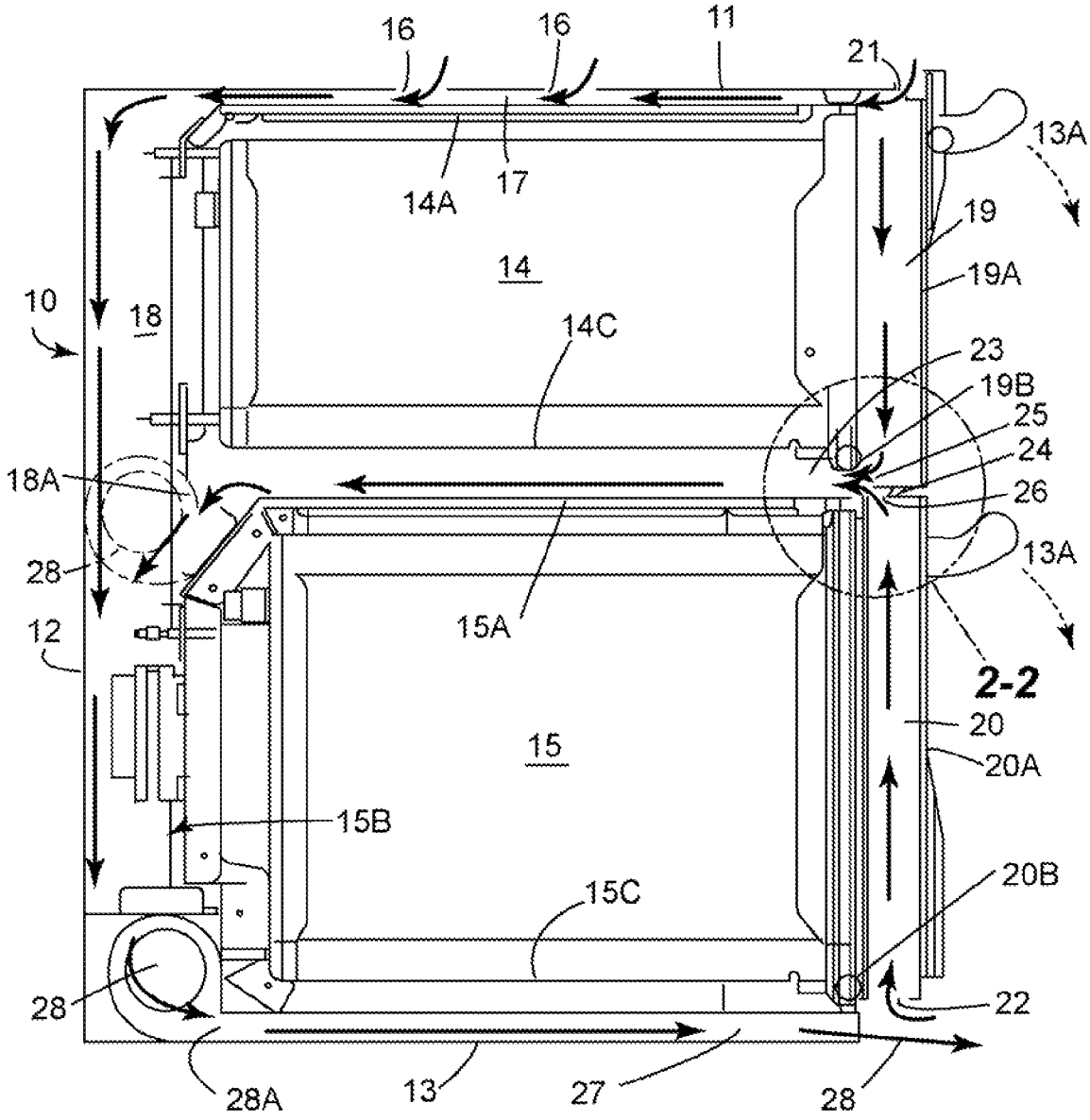
FIG. 1 is a schematic, side view of an exemplary dual-cavity oven incorporating an embodiment of a reverse airflow cooling system of the present invention.

An exemplary appliance such as a dual-cavity oven incorporating an embodiment of the reverse airflow cooling system of the present invention is generally designated by reference numeral 10 in FIG. 1. FIG. 1 is a schematic, elevational side view of a cross section of such an oven, showing an oven cabinet or a main body comprising a top 11, a back 12, opposing sides 33 (see FIG. 5), a bottom 13 and an open front at side 13A. The top 11 is shown having air inlets 16. These can be vents, grill, holes or other configurations as known in the art, spaced across top 11. The number and pattern of the air inlets may vary depending on the inlet airflow requirements for a particular appliance configuration.

The oven cabinet surrounds or defines an upper oven cavity or chamber 14 and a lower oven cavity or chamber 15. As exemplified in FIG. 1, the top 11 of the oven cabinet and the back 12 of the oven cabinet are outwardly spaced from the upper and lower oven cavities 14 and 15. The spacing is sufficient to define an air passage, between the top 14A of the upper oven cavity and the top 11 of the oven cabinet, and the back 12 of the oven cabinet and the backs 14B, 15B of the upper and lower oven cavities 14, 15. The air chamber thus created is generally shown as comprised of sub air chambers 17 and 18, which are fluidly contiguous with each other. The sub air chamber 17 is in flow or fluid communication with the air inlets 16.

The embodiment of FIG. 1 shows the upper oven cavity 14 situated above the lower oven cavity 15. The upper oven cavity 14 is spaced from the lower oven cavity 15 to form a center air channel 23 therebetween. In the embodiment illustrated in FIG. 1, the center air channel 23 is comprised of the space defined generally between the bottom 14C of the upper oven cavity 14 and the top 15A of the lower oven cavity 15, and the center air channel 23 runs the length of the upper and lower oven cavities 14, 15 and can extend up to the width of same. As shown, the center air channel 23 is in flow or fluid communication with the sub air chamber 18 at point 18A, although other points of intersection can be used.

The upper and lower oven cavities 14 and 15 each have a front-opening access doors 19A, 20A (i.e., the upper and lower oven cavity doors). In the embodiment shown, the access doors 19A, 20A open downwardly from hinge points 19B and 20B, the movement indicated by the dotted arrows. The access doors 19A and 20A each are configured to have internal airways which are generally designated by reference numerals 19 and 20. The internal airways 19, 20 generally run the length of the respective access doors 19A, 20A, and can extend across the width of the access doors 19A, 20A and be configured the same or differently from each other. The access door 19A of the upper oven cavity 14 is shown having an air inlet 21 proximate the top of the access door 19A, and an air outlet 25 proximate the bottom thereof. The air inlet 21 and the air outlet 25 are in flow or fluid communication with the internal airway 19. The air outlet 25 is adjacent to the intake end of the center air channel 23 so that the internal airway 19 is in flow or fluid communication with the center air channel 23. The access door 20A of the lower oven cavity 15 is shown having an air inlet 22 proximate the bottom of the access door 20A and an air outlet 26 proximate the top of the access door 20A. The air inlet 22 and the air outlet 26 are in flow or fluid communication with the internal airway 20. The air outlet 26 is adjacent to the intake end of the center air channel 23 so that the internal airway 20 is in flow or fluid communication with the center air channel 23. As used throughout this specification "proximate" or "adjacent" means at or near.

A fan 28 is preferably located within the sub air chamber 18 and at the back 12 of the oven cabinet. As used herein "a fan" means one or more fans. The term "fan" includes fans, blowers and other devices suitable for moving air. The fan 28 is configured to create a negative pressure at its entry side when operating. The negative pressure (i.e., vacuum) is created in the direction toward the bottom 13 of the oven cabinet to pull ambient air, typically cooler kitchen air, through the air inlets 16, 21, 22, in order to promote the ambient air to flow through the internal airways 19, 20 of the access doors 19A, 20A, the sub air chambers 17, 18, and the center air channel 23 so that the access doors 19A, 20A are cooled by the passing ambient air. In FIG. 1, the cooling ambient airflow thus generated is shown in bold arrows.

In the embodiment shown in FIG. 1, the fan 28 is located within the sub air chamber 18 and proximate the bottom 13 of the oven cabinet and behind the lower oven cavity 15. Alternatively, the fan 28 could be located within the sub air chamber 18, behind the upper and lower oven cavities 14, 15 and substantially aligned with the center air channel 23, e.g. located in-between the backs 14B, 15B of the upper and lower oven cavities 14, 15 illustrated in phantom in FIG. 1 as fan 28.

The fan 28 has an outlet side 28A connected to a duct 27 exhausting at the open front 13A of the oven cabinet. The embodiment shown in FIG. 1 depicts the duct 27 extending beneath the lower oven cavity 15 and exhausting to the ambient air at point 28 at the open front 13A of the oven cabinet. The duct 27 can be otherwise placed, such as, without limitation, along one or both sides 33 of the oven cabinet, either internally or externally.

The center air channel 23, the duct 27 and/or at least part of the sub air chambers 17, 18 form or constitute a continuous air channel.

Figure 2:
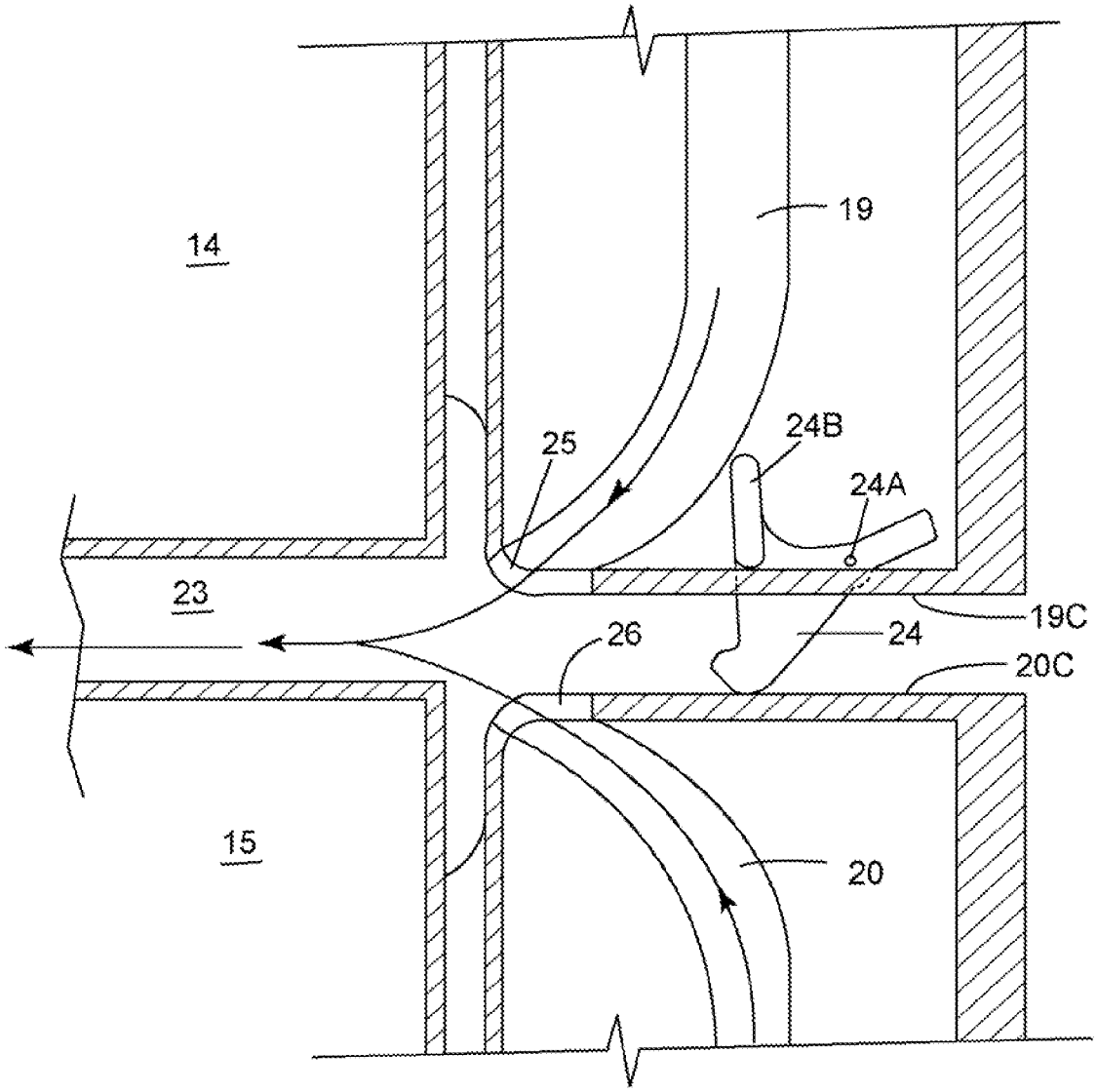
FIG. 2 is an enlarged side view of the area circled in FIG. 1.

In the embodiment of FIG. 1, a sealing wiper 24 is incorporated to seal the center air channel 23 from drawing in ambient air from the space between the access doors 19A, 20A when the access doors 19A, 20A are closed. The seal may but need not be airtight and can be sufficient to impede significant leakage or flow of ambient air into the center air channel 23. Turning to FIG. 2, which enlarges the circled area of relevance in FIG. 1, the wiper 24 is shown as extending from the bottom 19C of the access door 19A to the top 20C of the access door 20A. In this configuration, gravity holds the wiper 24 against the top 20C of the access door 20A. Other configurations, such as springs and other forms of compressive force, can be used to hold the wiper 24 in place. In addition, the wiper 24 can be attached to the top 20C of the access door 20A and extend upward or outward to reach the bottom 19C of the access door 19A. The wiper 24 is shown having two pivot points 24A around which it can freely rotate when at least one of the access doors 19A, 20A is opened. The wiper 24 preferably has molded-in hard stops 24B proximate each end, as show more clearly in FIG. 3A. In the embodiment shown in FIG. 2, the air outlets 25 and 26 are aft of the wiper 24 so that when wiper 24 is in closed position (as depicted in FIG. 2), the reverse air flow (bold arrows) generated by the fan 28 does not pull in ambient air that would otherwise be drawn into the system through the space generally delimited by the bottom 19C and the top 20C extant between the access doors 19A, 20A which would adversely affect the effect of the reverse airflow cooling otherwise obtainable.

Figure 3A:
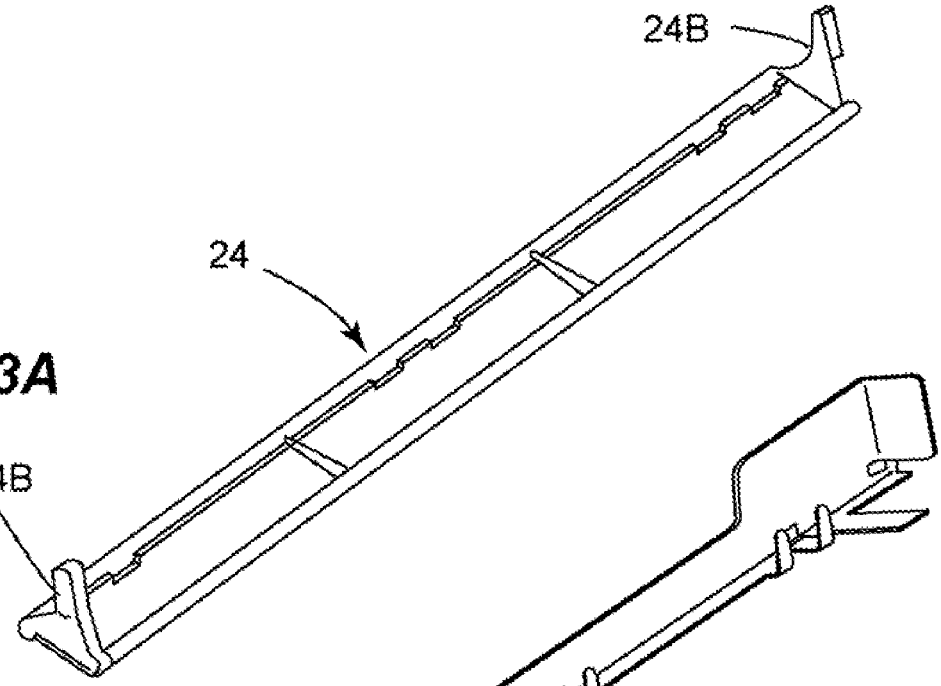
FIG. 3A is a perspective view of an embodiment of a wiper.

As shown in FIG. 3A, the wiper 24 is generally of elongate shape extending substantially across the bottom 19C of the access door 19A or a portion thereof sufficient to seal out ambient air leakage into the center air channel 23. Embodiments of these aspects of the present invention are depicted, for example, at FIG. 3A, 3C and FIGS. 4A and 4C. The wiper 24 can be comprised of numerous materials of construction as appreciated by the artisan, including without limitation, rubber or other elastomeric material adequate to form the seal aforesaid.

Figure 3B:
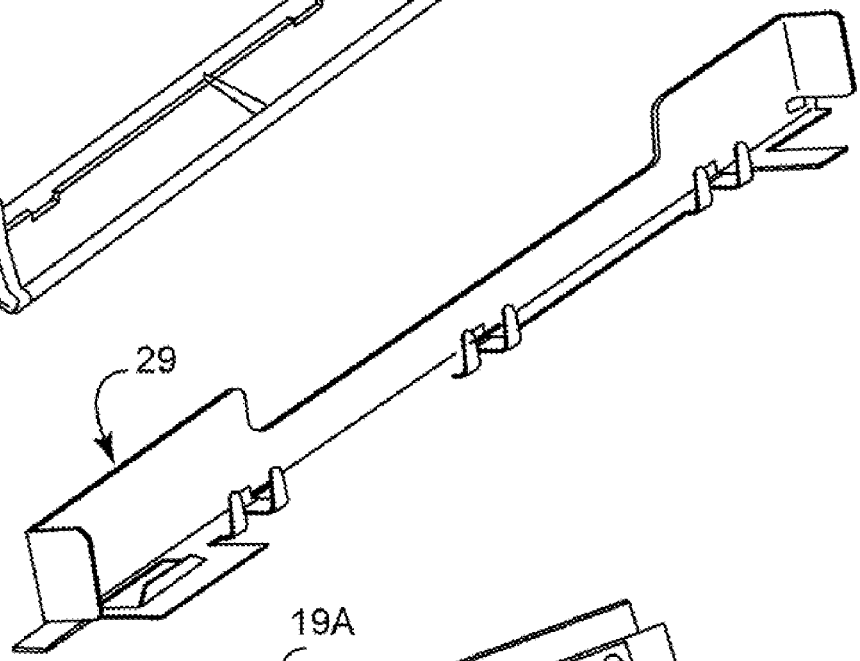
FIG. 3B is a perspective view of an exemplary frame used to incorporate the wiper of FIG. 3A in the oven of FIG. 1.
Figure 3C:
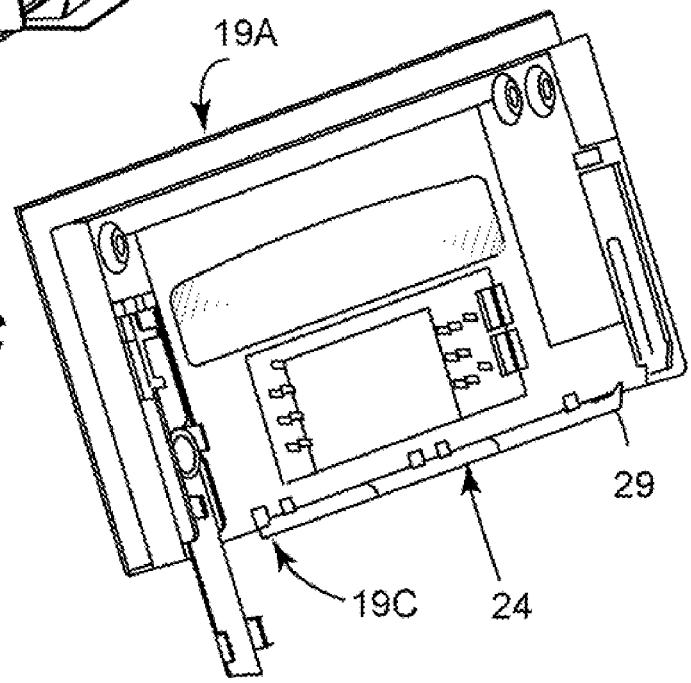
FIG. 3C is a perspective view, showing the wiper of FIG. 3A attached to the bottom of an upper oven cavity door using the frame of FIG. 3B.

FIG. 3A illustrates an embodiment of the wiper 24 having the cross section depicted in FIG. 2. In the embodiment shown, the wiper 24 is designed to snap fit into a frame 29 which is shown in FIG. 3B. As shown in FIG. 3C, the frame 29, in turn, can be either formed integral with the bottom 19C of the access door 19A, or can be separately attached to same.

Figure 4C:
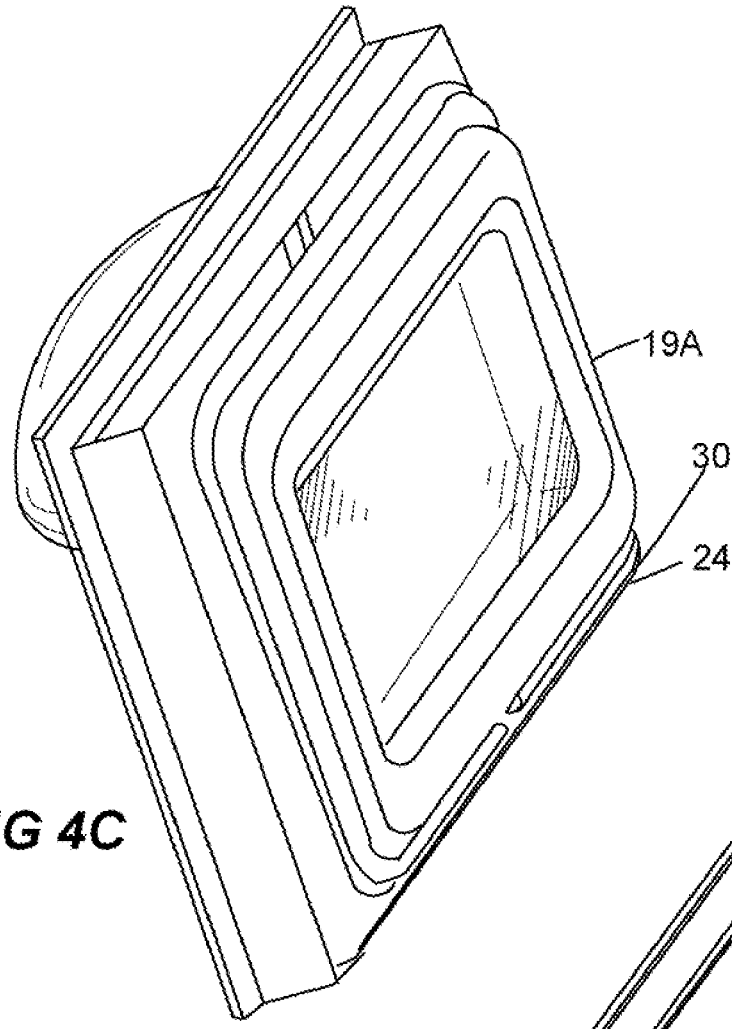
FIG. 4C is a perspective view, showing the wiper of FIG. 4A attached to the bottom of the upper oven cavity door using the spring element of FIG. 4B.
Figure 4B:
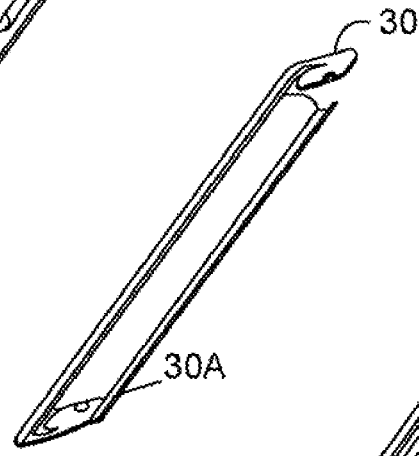
FIG. 4B is a perspective view of a spring element used to incorporate the wiper of FIG. 4A in the oven of FIG. 1.
Figure 4A:
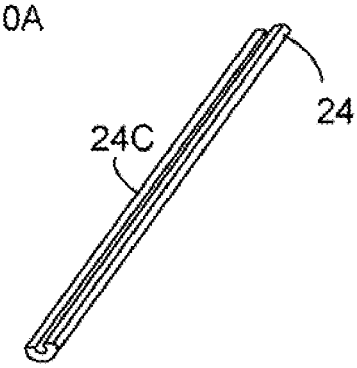
FIG. 4A is a perspective view of another embodiment of the wiper.

FIGS. 4A, 4B and 4C show another embodiment of the wiper 24 wherein a generally semicircular cross sectional shape having a slot 24C longitudinally disposed. Without limitation, in this embodiment, the slot 24C can be used to slide the wiper 24 onto the peripheral edge 30A of a spring element 30. The spring element 30 can be either formed integral with the bottom 19C of the access door 19A, or can be separately attached to same.

Another embodiment of the invention provides an HMI integrated into one or both doors of a dual-cavity oven that incorporates the reverse airflow system of the invention. The inventive cooling system manifests oven door surface temperatures that are lower than hitherto achievable to a degree where the HMI can be integrated therein. The HMI provides the interface between the consumer and the mechanical, electronic or electromechanical control of the oven. In an embodiment, it includes an arrangement of keys or knobs for the consumer to activate and deactivate functions provided by the oven. In another embodiment, the HMI can provide feedback to the consumer, e.g., display or other indicators that inform of the operating status of the oven.

Figure 5:
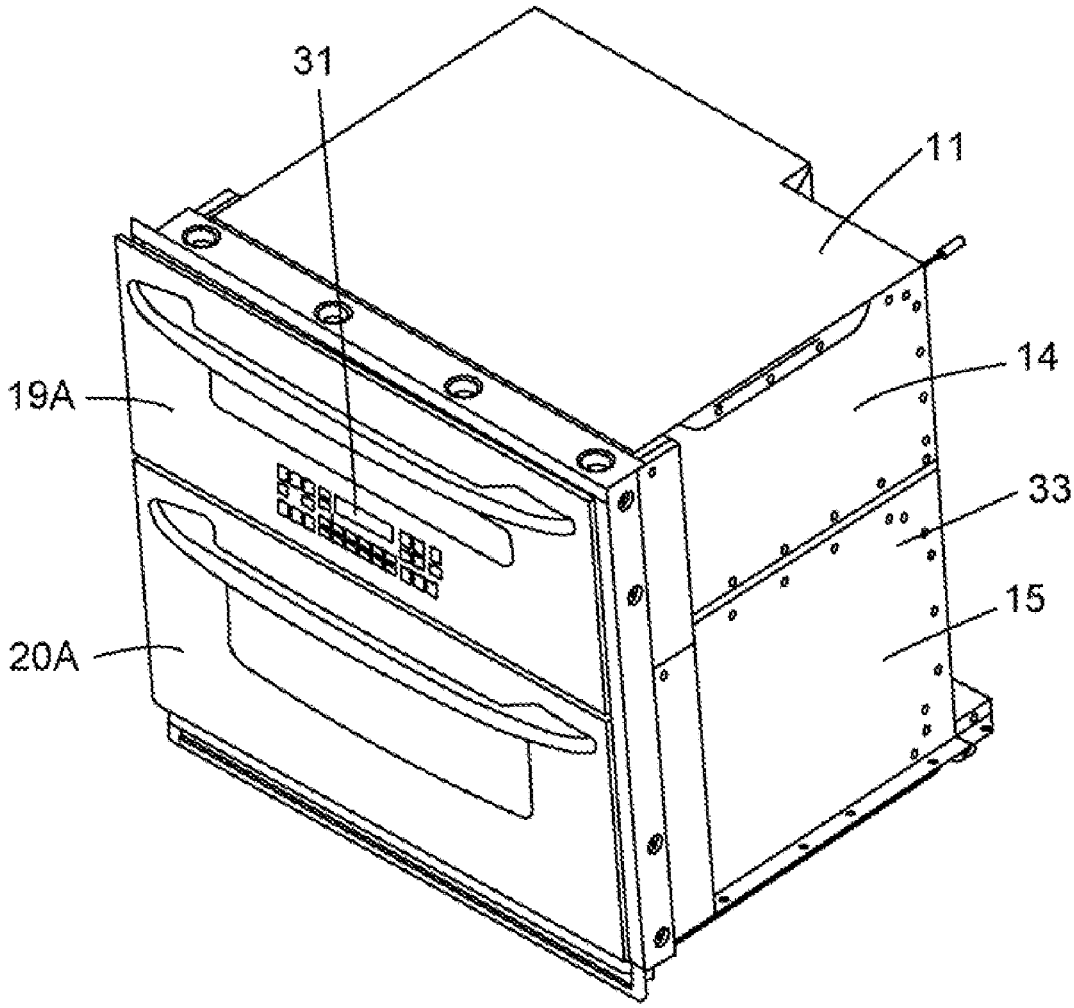
FIG. 5 is a perspective view of the oven of FIG. 1, showing a HMI integrated into the upper oven cavity door.

One practice of this embodiment of the invention is shown in FIG. 5. The dual-cavity oven depicted in FIG. 5 incorporates the reverse airflow cooling system of the present invention. The cooling thereby provided to the access doors 19A, 20A enables the HMI 31 to be integrated into at least one of the access doors 19A, 20A (FIG. 5 shows the HMI 31 is in the access door 19A). The HMI 31 typically includes input and output components for consumer interfacing and feedback via a display module. Without limitation, input components for the HMI 31 can include keys, knobs, glass touch keys (e.g., glass capacitive touch technology or field-effect switch technology), switches integrated into a membrane that can be adhered to the door, tactile buttons that can be integrated into the door, or knobs that can traverse through the door. Without limitation, display components for the HMI 31 can include displays employing light emitting diodes (LEDs), vacuum fluorescent displays (VFDs), or liquid crystal displays (LCDs). The HMI 31 depicted in FIG. 5 can employ one or more of the elements described herein.

Thus, while there have shown and described and pointed out fundamental novel features of the invention as applied to an embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An appliance comprising:

a main body defining a first cavity, a second cavity adjacent to the first cavity, and an air channel which is in flow communication with an outside of the appliance, the air channel comprising a center air channel disposed between the first cavity and the second cavity and having an intake end;

a first access door attached to the main body for selectively closing the first cavity, the first access door having a first airway in flow communication with the outside of the appliance and the air channel;

a second access door attached to the main body for selectively closing the second cavity, the second access door having a second airway in flow communication with the outside of the appliance and the air channel; and a fan disposed in the air channel, wherein each of the first airway and the second airway has an air outlet which is disposed adjacent to the intake end, and wherein when activated, the fan causes ambient air from outside of the appliance to pass through the first airway and the second airway before entering the air channel so that the first and second access doors are cooled by the ambient air.

2. The appliance of claim 1, further comprising a sealing wiper disposed between the first access door and the second access door when the first access door and the second access door close the first cavity and the second cavity, respectively.

3. The appliance of claim 2, wherein the sealing wiper is supported by one of the first access door and the second access door.

4. The appliance of claim 2, wherein the sealing wiper is pivotably attached to the one of the first access door and the second access door and is configured to extend outward to reach the other of the first access door and the second access door.

5. The appliance of claim 2, further comprising a Human Machine Interface integrated into at least one of the first access door and the second access door.

6. An appliance comprising:

a main body defining a first cavity, a second cavity adjacent to the first cavity, and an air channel which is in flow communication with an outside of the appliance;

a first access door attached to the main body for selectively closing the first cavity, the first access door having a first airway in flow communication with the outside of the appliance and the air channel;

a second access door attached to the main body for selectively closing the second cavity, the second access door having a second airway in flow communication with the outside of the appliance and the air channel;

a sealing wiper disposed between the first access door and the second access door when the first access door and the second access door close the first cavity and the second cavity, respectively; and a fan disposed in the air channel, wherein when activated, the fan causes ambient air from outside of the appliance to pass through the first airway and the second airway before entering the air channel so that the first and second access doors are cooled by the ambient air.

7. The appliance of claim 6, wherein the sealing wiper is supported by one of the first access door and the second access door.

8. The appliance of claim 7, wherein the sealing wiper is pivotably attached to the one of the first access door and the second access door and is configured to extend outward to reach the other of the first access door and the second access door.

9. The appliance of claim 6, wherein the sealing wiper comprises opposite ends and a stop adjacent to each of the opposite ends.

10. The appliance of claim 6, wherein the air channel comprises an intake end, each of the first airway and the second airway having an air outlet which is disposed adjacent to the intake end and between the intake end and the sealing wiper.

11. The appliance of claim 6, further comprising a Human Machine Interface integrated into at least one of the first access door and the second access door.

12. The appliance of claim 11, wherein the Human Machine Interface comprises at least one of a consumer interface and a feedback display.

13. The appliance of claim 6, wherein the fan is disposed behind the second cavity.

14. The appliance of claim 6, wherein the air channel comprises a center air channel disposed between the first cavity and the second cavity, the fan being substantially aligned with the center air channel.

15. An appliance comprising:

a cabinet having a top, a bottom, opposing sides, a back, an open front, upper and lower oven cavities, and upper and lower access doors for selectively closing the respective upper and lower oven cavities, the upper access door having a lower edge and the lower access door having an upper edge, the lower and upper edges defining a space therebetween, the cabinet defining:

a first air flow channel disposed between the top and the back and the upper and lower oven cavities, the first air flow channel having a first air inlet;

a center air channel between the upper and lower oven cavities and in flow communication with the first air flow channel;

an internal airway in each of the upper and lower access doors, each internal airway having a second air inlet and an air outlet which is in flow communication with the center air channel; and a lower air channel extending back to front beneath the lower oven cavity and in flow communication with the first air flow channel; and a sealing wiper disposed to span the space between the lower and upper edges when the upper and lower access doors are in closed positions to limit ambient air entering the center air channel; and a fan disposed proximate a back portion of the appliance, the fan being configured to create negative pressure to pull ambient air through the first and second air inlets and the internal airways of the upper and lower access doors and force air through the lower air channel to the exterior of the appliance so that the upper and lower access doors are cooled by the ambient air.

16. The appliance of claim 15, wherein the sealing wiper is pivotably attached to the upper access door and extends outward to reach the lower access door.

17. The appliance of claim 15, wherein the fan is disposed adjacent to the bottom and behind the lower oven cavity.

18. The appliance of claim 15, wherein the fan is disposed behind and in between the upper and lower oven cavities.

19. The appliance of claim 15, further comprising a Human Machine Interface integrated into at least one of the upper and lower access doors.

20. The appliance of claim 19, wherein the Human Machine Interface comprises at least one of a consumer interface and a feedback display.

* * * * *